United States Patent [19]

Cordes et al.

[11] 4,302,367

[45] Nov. 24, 1981

[54] PAPER-COATING COMPOSITIONS

[75] Inventors: Claus Cordes, Weisenheim; Guenter Hirsch, Mutterstadt; Heinrich Hartmann, Limburgerhof, all of Fed. Rep. of Germany

[73] Assignee: BASF Aktiengesellschaft, Ludwigshafen, Fed. Rep. of Germany

[21] Appl. No.: 124,079

[22] Filed: Feb. 25, 1980

[30] Foreign Application Priority Data

Mar. 2, 1979 [DE] Fed. Rep. of Germany ..... 2908201

[51] Int. Cl.[3] ..... C08J 3/06; C08L 9/10; C08L 9/08; C08L 33/08

[52] U.S. Cl. ..... 260/17 R; 260/8; 260/17.4 ST; 260/29.6 RW; 260/29.6 WA; 260/29.7 W; 260/29.7 WA

[58] Field of Search ..... 260/8, 17 R, 17.4 ST, 260/29.6 RW, 29.6 WA, 29.6 MH, 29.6 WQ, 29.7 W, 29.7 WA

[56] References Cited

U.S. PATENT DOCUMENTS

| | | | |
|---|---|---|---|
| 2,998,400 | 8/1961 | French | 260/29.6 RW |
| 3,844,990 | 10/1974 | Lindemann et al. | 260/17 R |
| 3,979,349 | 9/1976 | Fink et al. | 260/29.6 RW |
| 3,996,180 | 12/1976 | Kane | 260/29.6 H |
| 4,157,995 | 6/1979 | Schenk et al. | 260/29.6 RW |

*Primary Examiner*—Earl A. Nielsen
*Attorney, Agent, or Firm*—Oblon, Fisher, Spivak, McClelland & Maier

[57] ABSTRACT

An improved paper-coating composition containing, per 100 parts by weight of finely divided pigment, from 5 to 25 parts by weight of one or more copolymers, having a glass transition temperature of from −40° to 50° C., in the form of an aqueous dispersion, and from 0.1 to 10 parts by weight of one or more water-soluble or water-swellable co-binders selected from the group comprising polyvinyl alcohol, cellulose ethers, starch, casein, alginates and high molecular weight carboxyl-containing emulsion polymers. The co-binder is added to the paper-coating composition in the form of a water-in-oil emulsion. Paper-coating compositions having high water retention are obtained, and papers coated with such compositions have improved water resistance.

8 Claims, No Drawings

PAPER-COATING COMPOSITIONS

The production of coated printing papers conventionally employs paper-coating compositions which essentially consist of a pigment dispersed in water, for example kaolin, calcium carbonate or titanium dioxide, and one or more binders. Whilst in the past the binders used were exclusively high molecular weight natural products, such as starch or casein, attempts are being made increasingly to replace the natural products entirely or partially by synthetic high molecular weight polymers in the form of aqueous dispersions. Binders based on natural products have the disadvantages that they are not always obtained in constant quality, that they are sensitive to attack by micro-organisms, that they must be digested by expensive processes, and they give brittle coatings. It is true that binders based on synthetic high molecular weight polymers do not exhibit all the above disadvantages of natural binders, but they nevertheless still require certain improvements.

U.S. Pat. No. 3,081,198 discloses the use, as a binder for paper-coating compositions, of a mixture of an alkali-insoluble polymer dispersion and an alkali-soluble copolymer which contains from 15 to 40% by weight of an ethylenically unsaturated carboxylic acid as copolymerized units. Instead of the polymer dispersion, a binder based on natural products, eg. casein, or soybean protein, may be used. Howevwer, the water resistance of coated papers obtained when using these binders in paper-coating compositions is insufficient. Furthermore, the conventional paper-coating compositions cannot always be used satisfactorily on high-speed coating machinery.

It is an object of the present invention to provide a paper-coating composition which exhibits high water retention and gives coated papers having high water resistance.

We have found that this object is achieved, according to the invention, with a paper-coating composition containing, per 100 parts by weight of finely divided pigment, a binder comprising from 5 to 25 parts by weight of one or more copolymers having a glass transition temperature of from −40° to +50° C., in the form of an aqueous dispersion, and from 0.1 to 10 parts by weight of one or more water-soluble or water-swellable co-binders selected from the group consisting of polyvinyl alcohol, modified cellulose, starch, casein, alginates or high molecular weight carboxyl-containing polymers, if the co-binder is converted to a water-in-oil emulsion by emulsification in a hydrocarbon oil and is incorporated, in this form, into the paper-coating composition.

The above binder combinations impart high water retention to the paper-coating compositions according to the invention, so that they are readily processable on conventional coating equipment. Furthermore, the coated papers obtained have substantially higher water resistance than papers which have been coated with the conventional paper-coating compositions.

Suitable copolymers, having a glass transition temperature of from −40° to +50° C., which may be used in the binder mixture are all commercial synthetic binders which are in the form of an aqueous dispersion even at a pH above 7 and which have been proposed for the preparation of paper-coating compositions. Examples of typical monomers whose units may be present in the copolymers are esters of acrylic acid and methacrylic acid, acrylonitrile, methacrylonitrile, acrylamide, methacrylamide, ethylenically unsaturated $C_3$–$C_5$-monocarboxylic acids and -dicarboxylic acids, half-esters of ethylenically unsaturated $C_3$–$C_5$-dicarboxylic acids, vinyl chloride, vinylidene chloride, hydrocarbons with one or more ethylenic double bonds, eg. ethylene, propylene, butylene, 4-methylpent-1-ene, styrene, butadiene, isoprene and chloroprene, vinyl esters, vinylsulfonic acid and esters of ethylenically unsaturated carboxylic acids derived from polyhydric alcohols, eg. hydroxypropyl acrylate and hydroxypropyl methacrylate.

Suitable binders are disclosed, for example, in German Published Application DAS No. 1,100,450. Such copolymers may, in addition to an acrylic acid ester, contain styrene and/or butadiene and/or acrylonitrile and ethylenically unsaturated acids as copolymerized units. Instead of the acids, other polymerizable hydrophilic compounds may be present as copolymerized units, for example hydroxyl-containing monomers, eg. hydroxypropyl acrylate and hydroxypropyl methacrylate. The acrylic acid esters employed in the polymerization may for example be derived from monohydric alcohols of 1 to 12 carbon atoms. The acrylic acid ester content in these copolymers can vary within wide limits, for example from 10 to 99%, and homopolymers of acrylic acid esters may also be used. The content of ethylenically unsaturated acids in these copolymers is as a rule under 10% by weight. Suitable ethylenically unsaturated acids are, in particular, acrylic acid, methacrylic acid, vinylsulfonic acid, acrylamidopropanesulfonic acid and itaconic acid.

The polymethacrylates have a similar structure to the polyacrylates but instead of an acrylic acid ester contain a methacrylic acid ester. However, it is also possible to copolymerize acrylic acid esters or methacrylic acid esters conjointly with other ethylenically unsaturated compounds and use the product as a constituent of the binder combination. Examples of other suitable comonomers are ethylene and propylene.

Other suitable copolymers for use in the binder mixture are copolymers of butadiene and styrene. These contain from 20 to 60% by weight of butadiene and from 40 to 80% by weight of styrene with or without acrylonitrile. They may contain other comonomers, for example esters of ethylenically unsaturated carboxylic acids of 3 to 5 carbon atoms, with or without up to 10% by weight of other ethylenically unsaturated copolymerizable compounds, eg. acrylic acid, methacrylic acid, maleic acid, crotonic acid and fumaric acid. Polymers of this type, as well as polyacrylates, are disclosed, for example, in German Pat. No. 1,546,316. Suitable styrene/butadiene copolymers which contain an ethylenically unsaturated carboxylic acid or a half-ester of an ethylenically unsaturated dicarboxylic acid as copolymerized units and may be used as the copolymer in the binder mixture are disclosed in German Published Application DAS No. 1,221,748.

Other polymers which may be used as binders in the paper-coating composition according to the invention are those derived from vinyl esters, for example of the type of vinyl acetate or vinyl propionate, and from polymerizable hydrocarbons, eg. ethylene or propylene, for example copolymers of vinyl esters with acrylic acid esters and/or methacrylic acid esters and/or acrylonitrile, and copolymers of ethylene, vinyl acetate and acrylic acid and other polymerizable hydrophilic compounds, for example ethylenically unsaturated acids or hydroxyl-containing monomers. The copolymers can also contain other ethylenically unsaturated compounds as copolymerized units, for example acrylamide, N-methylolacrylamide, N-methylolmethacrylamide, vinyl chloride and vinylidene chloride. Examples of suitable vinyl ester copolymers are disclosed in German Pat. No. 1,264,945. Homopolymers of vinyl esters may also be used.

The co-binders, by contrast, are soluble or swellable in water or in aqueous bases. Suitable co-binders include polyvinyl alcohol, modified celluloses, starch, casein, alginates and high molecular weight carboxyl-containing polymers. Products of this type are known and have been proposed for the formulation of paper-coating compositions, so that they do not require detailed comment here. Polyvinyl alcohol, when used as a co-binder according to the invention, has a degree of hydrolysis of greater than 80 mole % and a viscosity of, preferably, from 2 to 70 mPas (measured according to DIN 53,015 on a 4% strength aqueous solution at 20° C.). Other co-binders which may be used are natural polymers or their derivatives, eg. casein, starch, alginates or modified celluloses, eg. cellulose ethers or cellulose esters. Preferred co-binders are polyvinyl alcohol and carboxymethylcellulose.

Further suitable co-binders are emulsion polymers which are prepared by copolymerizing (a) from 10 to 50% by weight of acrylic acid, methacrylic acid, maleic acid and/or a maleic acid half-ester, (b) from 20 to 80% by weight of monomers which form water-insoluble homopolymers, eg. hydroxyethyl acrylate, hydroxypropyl acrylate, hydroxybutyl acrylate, styrene, vinyl chloride and/or vinylidene chloride, and (c) from 5 to 50% by weight of acrylonitrile, methacrylonitrile, esters of acrylic acid or methacrylic acid with monohydric $C_1$–$C_4$-alcohols and vinyl esters of saturated $C_2$–$C_4$-carboxylic acids, in aqueous emulsion. Homopolymers of acrylic acid and/or methacrylic acid prepared by polymerizing the monomers in aqueous emulsion may also be used as co-binders.

These copolymers are to be regarded as both co-binders and thickeners, i.e., they also act as thickeners. They are soluble at above pH 6. On addition of ammonia or an alkali metal hydroxide solution, they give a clear solution and increase the viscosity of the aqueous systems.

It is an essential characteristic of the present invention that the water-soluble or water-swellable co-binders are converted to a water-in-oil emulsion. This process step is carried out in the conventional manner by mixing an aqueous solution or dispersion of the co-binder with a water-insoluble oil, preferably a hydrophobic hydrocarbon or derivative thereof, in the presence of a special emulsifier, and thereby converting it to a stable water-in-oil emulsion. This process step is also feasible at a pH below 6, so that the alkali-soluble copolymers described above, which at a pH below 6 are in the form of an aqueous dispersion, can be converted, as such, into a water-in-oil emulsion.

Water-in-oil emulsions are emulsions which have a lipophilic continuous oily phase, in which the aqueous phase, containing the water-soluble, water-swellable or water-dispersed co-binder, is emulsified. Examples of suitable continuous outer oily phases of the water-in-oil emulsion are hydrophobic hydrocarbons, eg. gasoline cuts, and chlorohydrocarbons, eg. perchloroethylene and 1,2-dichloroethane. The proportion of aqueous emulsified phase is, for example, from 30 to 70% by weight of the emulsion, but may also be higher and amount to as much as 90% by weight. To disperse the aqueous phase, containing the co-binder, in the hydrocarbon oil, water-in-oil emulsifiers are used, as is conventionally the case, for example sorbitan monostearate, sorbitan monooleate, glycerol esters whereof the acid component is derived from $C_{14}$–$C_{20}$-carboxylic acids, sodium cetyl/stearyl phthalate or the emulsifiers described in German Laid-Open Application DOS No. 2,536,537.

These emulsifiers have an HLB value of at most 8. The HLB value indicates the hydrophilic-lipophilic balance of the emulsifier, ie. the balance of size and strength of the hydrophilic and lipophilic groups of the emulsifier. A definition of this concept is to be found in, for example "Das Atlas HLB-System", Atlas Chemie GmbH, EC 10 G July 1971, and in Classification of Surface Active Agents by "HLB", W. C. Griffin, Journal of the Society of Cosmetic Chemists, page 311 (1950).

The finished emulsion contains from 0.1 to 30, preferably from 1 to 15, % by weight of these emulsifiers.

At times it can be advantageous first to prepare the water-in-oil emulsion with more water in the aqueous polymer phase than is ultimately desired, and then to remove the excess water from the emulsion, for example by distillation.

It is also possible to add a wetting agent, having an HLB value greater than 10, to the water-in-oil emulsion. Essentially, such wetting agents are hydrophilic water-soluble products, such as oxyethylated alkylphenols, sodium dialkylsulfosuccinates, where alkyl is of not less than 3 carbon atoms, soaps derived from fatty acids of 10 to 22 carbon atoms, and alkali metal salts of alkyl-sulfates or alkenyl-sulfates of 10 to 26 carbon atoms. The use of oxyethylated nonylphenols of degree of oxyethylation from 6 to 20, oxyethylated nonylphenol/formaldehyde resins of degree of oxyethylation from 6 to 20, sodium dioctyl-sulfosuccinate and octylphenol-polyethoxyethanol is preferred.

The finished water-in-oil emulsion contains, for example, from 30 to 70% of an aqueous phase containing the co-binder. The concentration of the latter in the aqueous phase is from 20 to 60% by weight. The optionally used wetting agent having an HLB value greater than 10 is present in an amount of from 0.1 to 20% by weight, based on the total emulsion. The continuous outer phase of the water-in-oil emulsion accounts for from 10 to 70% by weight of the total emulsion.

It is also possible to use more than one water-soluble or water-swellable co-binder in preparing the paper-coating composition. Such mixtures are obtained, for example, by preparing an aqueous solution of two or more co-binders and then emulsifying this solution in a hydrocarbon oil. An alternative procedure is to emulsify the solution of a single co-binder in a hydrocarbon oil and mix the resulting water-in-oil emulsion with a water-in-oil emulsion of a different water-soluble or water-swellable co-binder. Examples of suitable mixtures of this type are co-binder mixtures of polyvinyl alcohol and starch, or of polyvinyl alcohol and butadiene/styrene copolymers.

In a further embodiment of the invention, water-in-oil emulsions of the co-binders described above are combined with water-in-oil emulsions of copolymers which have been prepared by polymerizing water-soluble monomers in a water-in-oil emulsion. Examples of suitable water-soluble ethylenically unsaturated monomers which can be polymerized in this way are acrylic acid, methacrylic acid and mixtures of the said carboxylic acids with the corresponding amides or nitriles.

The paper-coating compositions according to the invention contain, per 100 parts by weight of a finely divided pigment, from 5 to 25 parts by weight of a copolymer, present in the form of an aqueous dispersion, as the binder, and from 0.1 to 10 parts by weight of one or more water-soluble or water-swellable co-binders in the form of a water-in-oil emulsion. To prepare the paper-coating compositions according to the invention, the binders and co-binders are mixed in a conventional manner with fillers and pigments. Suitable pigments of this type are, in particular, clay minerals, calcium carbonates, calcium aluminum pigments and titanium dioxide. Other auxiliaries may also be added to the paper-coating compositions, for example alkalis, eg. sodium hydroxide, potassium hydroxide or ammonia, or white pigments based on water-insoluble urea-formaldehyde condensation products or on the corresponding melamine-formaldehyde condensation products, or other known paper assistants, eg. urea, melamine, melamine-formaldehyde resins or urea-formaldehyde resins. To achieve good dispersion of the ingredients, from 0.5 to 5% by weight of a dispersant is used as a rule, the dispersant being, for example, a low molecular weight polymer of acrylic acid, especially the ammonium salt or sodium salt of polyacrylic acid having a K value from 10 to 25. The sequence in which the individual components of the paper-coating composition are mixed is not critical. However, it proves advantageous to add the water-in-oil emulsion of the co-binder at the end of the process of preparing the coating composition. The preferred co-binders are polyvinyl alcohol and modified celluloses, eg. cellulose ethers and cellulose esters.

The Examples which follow illustrate the invention. In the Examples, parts and percentages are by weight, unless stated otherwise.

The water retention of the coating compositions is quoted in seconds and is the time within which the aqueous phase, dyed with an acid red dye, of the coating composition has penetrated through a Blauband filter to the extent that it has reduced the reflectance of the latter, measured by means of a reflectance photometer (filter 4), to 40% of the original reflectance.

The water resistance of the coating on the upper was determined by the wet rub test, wherein a drop of water is rubbed into the coated paper with a fixed number of rubbing motions, and is then blotted up on black paper. The abrasion is assessed on a scale of 1 to 5, with low values indicating good water resistance of the coating and high figures indicating poor water resistance.

Preparation of co-binder I 71 parts of a 15% strength aqueous solution of polyvinyl alcohol, having a viscosity of 18 mPas, 250 parts of a hydrocarbon mixture comprising 84% of saturated aliphatic hydrocarbons and 16% of naphthenic hydrocarbons (boiling point of the mixture 192°–254° C.) and 38.5 parts of the emulsifier described in Example 1 of German Laid-Open Application DOS No. 2,536,597 are introduced at room temperature into a vessel equipped with an efficient stirrer and are mixed until a coagulate-free, stable water-in-oil emulsion is obtained. 35 parts by weight of water are then distilled off under reduced pressure from a waterpump.

Preparation of co-binder II 71 parts of the 15% strength aqueous solution of a commercial low molecular weight carboxymethylcellulose, 225 parts by weight of the hydrocarbon mixture described above, 35 parts of sorbitan monooleate and 30 parts by weight of oxyethylated nonylphenol are mixed in the apparatus described above. After adequate mixing, a stable water-in-oil emulsion is obtained, from which 35 parts by weight of water are distilled off under reduced pressure from a waterpump. The resulting water-in-oil emulsion is referred to as co-binder II.

Preparation of co-binder III 71 parts of a 20% strength aqueous casein solution, 225 parts of the hydrocarbon mixture described above, 35 parts of the emulsifier described in Example 1 of German Laid-Open Application DOS No. 2,536,597 and 30 parts by weight of oxyethylated nonylphenol, having a degree of oxyethylation of 10, are mixed in the apparatus described above. After adequate mixing, and concentrating, as described for co-binder II, co-binder III is obtained as a stable water-in-oil emulsion.

Preparation of co-binder IV

Co-binder IV is prepared by a method similar to co-binder III, except that instead of the aqueous casein solution a 20% strength aqueous starch solution is employed.

Preparation of co-binder V

Co-binder V is also prepared by a method similar to that used for co-binder III. However, instead of the aqueous casein solution a 40% strength aqueous dispersion of a carboxyl-containing polymer of 80 parts of ethyl acrylate, 19 parts of acrylic acid and 1 part of acrylamide is employed.

EXAMPLE 1

To prepare a paper-coating composition suitable for offset printing paper, 90 parts of coating clay and 10 parts of calcium carbonate pigment are dispersed, in the presence of 0.2 part of sodium hydroxide solution and 0.3 part of a commercial dispersant based on low molecular weight polyacrylic acid, by means of a powerful dispersing unit, to give an aqueous slurry of about 66% strength. 12 parts (based on 100 parts of pigment) of an aqueous dispersion of a copolymer of 50% of n-butyl acrylate and 50% of styrene are added, as the binder, to the pigment slurry. Sufficient of co-binder I is then added, with vigorous stirring, to provide 2 parts of polyvinyl alcohol (based on 100 parts of pigment) in the coating composition. The solids content of the latter is brought to about 58% by adding water and the pH of 8.5 by adding sodium hydroxide solution. After a mixing time of 15 minutes, the paper-coating composition can be used, for example on a knife coater. The properties of the coating composition and the water resistance of the paper coated therewith are shown in the Table.

COMPARATIVE EXAMPLE 1

Comparative Example 1 differs from Example 1 only in that the 2 parts of polyvinyl alcohol are added as an aqueous solution instead of a water-in-oil emulsion.

EXAMPLE 2

Example 2 is carried out like Example 1, except that co-binder II is used instead of co-binder I and sufficient of the water-in-oil emulsion is added that the coating composition contains 2 parts of carboxymethylcellulose.

COMPARATIVE EXAMPLE 2

Example 2 is repeated with the sole difference that the 2 parts of carboxymethylcellulose are added as an aqueous solution and not as a water-in-oil emulsion.

EXAMPLE 3

The procedure followed is as described in Example 1, except that in place of co-binder I the same amount of co-binder III is used, and sufficient of the water-in-oil emulsion is added that the coating composition contains 2 parts of casein.

COMPARATIVE EXAMPLE 3

This differs from Example 3 only in that the casein is added as an aqueous solution.

EXAMPLE 4

Example 1 is repeated except that instead of co-binder I the same amount of co-binder IV is employed and the amount of water-in-oil emulsion added is such that the coating composition contains 2 parts of starch.

COMPARATIVE EXAMPLE 4

This differs from Example 4 only in that the starch is added as an aqueous solution.

EXAMPLE 5

Example 5 is carried out like Example 1 but using, instead of co-binder I, the same amount of co-binder V, the amount of water-in-oil emulsion added being such that the coating composition contains 2 parts of the high molecular weight carboxyl-containing polymer.

COMPARATIVE EXAMPLE 5

This differs from Example 5 only in that the high molecular weight polymer is added as an acid aqueous dispersion and not in the form of the water-in-oil emulsion prepared from this dispersion.

TABLE

| Properties | Example 1 | Comparative Example 1 | Example 2 | Comparative Example 2 | Example 3 | Comparative Example 3 | Example 4 | Comparative Example 4 | Example 5 | Comparative Example 5 |
|---|---|---|---|---|---|---|---|---|---|---|
| Viscosity of the paper-coating composition mPas | 1,920 | 1,708 | 3,970 | 3,460 | 3,100 | 2,700 | 420 | 570 | 1,090 | 1,120 |
| Water retention of the paper-coating composition sec | 35 | 21 | 147 | 107 | 93 | 64 | 66 | 48 | 60 | 45 |
| Water resistance of the coated paper - rating by the wet-rub test | 2 | 3 | 2 | 4 | 1–2 | 2–3 | 2 | 3–4 | 1–2 | 3 |

In evaluating the data in the Table, the following is found:

By employing the co-binder in accordance with the invention, as compared to employing it conventionally in aqueous solution, there is, in spite of the similar viscosity, a substantial increase in the water retention of the coating composition and an unforeseeable improvement in the wet-rub test, indicating an increase in the wet abrasion resistance and water resistance of the papers.

We claim:

1. An improved paper-coating composition containing, per 100 parts by weight of finely divided pigment, from 5 to 25 parts by weight of one or more copolymers, having a glass transition temperature of from −40° to 50° C., in the form of an aqueous dispersion, and from 0.1 to 10 parts by weight of one or more water-soluble or water-swellable co-binders selected from the group consisting of polyvinyl alcohol, cellulose ether, starch, casein and alginates, said composition being prepared by emulsifying said co-binder in a hydrocarbon oil to form a water-in-oil emulsion and then mixing the emulsion with the remaining components of the composition.

2. An improved paper-coating composition as claimed in claim 1, wherein the amount of the emulsified aqueous phase is from 30 to 90% by weight, based on the total weight of the water-in-oil emulsion.

3. An improved paper-coating composition as claimed in claim 1 or 2, wherein an emulsifier having an HLB value of at most 8 is used to produce the water-in-oil emulsion of the co-binder.

4. An improved paper-coating composition as claimed in claim 3, wherein from 1 to 15% by weight, based on the water-in-oil emulsion, of an emulsifier is used.

5. An improved paper-coating composition as claimed in claim 1, wherein a cellulose ether is used as the co-binder.

6. An improved paper-coating composition as claimed in claim 1, wherein a carboxymethyl cellulose is used as the co-binder.

7. An improved paper-coating composition as claimed in claim 1, wherein polyvinyl alcohol having a viscosity of from 2 to 70 mPas (measured according to DIN 53,015 in a 4% strength aqueous solution at 20° C.) is used as the co-binder.

8. An improved paper-coating composition containing 100 parts by weight of finely divided pigment, from 5 to 25 parts by weight of at least one copolymer, having a glass transition temperature of from −40° C. to 50° C., in the form of an aqueous dispersion, and from 0.1 to 10 parts by weight of polyvinyl alcohol as a water-soluble or water-swellable co-binder, said composition being prepared by emulsifying said co-binder in a hydrocarbon oil to form a water-in-oil emulsion and then mixing the emulsion with the remaining components of the composition.

* * * * *